US007511625B2

(12) United States Patent
Mardirossian

(10) Patent No.: US 7,511,625 B2
(45) Date of Patent: Mar. 31, 2009

(54) MINE SAFETY SYSTEM

(75) Inventor: Aris Mardirossian, Germantown, MD (US)

(73) Assignee: Technology Patents, LLC, Derwood, MD (US)

( * ) Notice: Subject to any disclaimer, the term of this patent is extended or adjusted under 35 U.S.C. 154(b) by 167 days.

(21) Appl. No.: 11/452,416

(22) Filed: Jun. 14, 2006

(65) Prior Publication Data

US 2008/0122634 A1 May 29, 2008

(51) Int. Cl.

| | |
|---|---|
| ***G08B 23/00*** | (2006.01) |
| *G08B 19/00* | (2006.01) |
| *G01V 1/00* | (2006.01) |
| *G01L 7/00* | (2006.01) |
| *A61M 16/00* | (2006.01) |
| *A61M 15/00* | (2006.01) |
| *E21F 1/00* | (2006.01) |
| *H04M 11/04* | (2006.01) |

(52) U.S. Cl. ..... 340/573.1; 340/521; 340/527; 367/36; 702/138; 128/204.21; 128/200.24; 454/168; 454/171; 455/404.2

(58) Field of Classification Search ..... 340/573.1, 340/521, 527; 702/138; 128/204.21, 200.24; 454/168, 171; 455/404.2
See application file for complete search history.

(56) References Cited

U.S. PATENT DOCUMENTS

| | | | | |
|---|---|---|---|---|
| 3,879,717 | A * | 4/1975 | Gruensfelder | 340/527 |
| 3,900,878 | A * | 8/1975 | Tsao | 340/854.5 |
| 3,949,353 | A | 4/1976 | Waters et al. | |
| 4,055,844 | A * | 10/1977 | Hornbostel, Jr. | 340/521 |
| 4,066,992 | A * | 1/1978 | Buller et al. | 367/36 |
| 4,581,712 | A * | 4/1986 | Perry et al. | 702/138 |
| 4,879,755 | A * | 11/1989 | Stolarczyk et al. | 725/41 |
| 5,093,929 | A | 3/1992 | Stolarczyk et al. | |
| 5,423,313 | A * | 6/1995 | Olsson et al. | 128/204.21 |
| 5,809,999 | A * | 9/1998 | Lang | 128/200.24 |
| 6,512,312 | B1 * | 1/2003 | Herkenrath et al. | 307/326 |
| 6,682,268 | B2 | 1/2004 | Robertson, Jr. et al. | |
| 2005/0117022 | A1 * | 6/2005 | Marchant | 348/207.11 |
| 2005/0193818 | A1 * | 9/2005 | Cobb | 73/579 |
| 2007/0228804 | A1 * | 10/2007 | Crayne et al. | 299/12 |

* cited by examiner

*Primary Examiner*—Daniel Wu
*Assistant Examiner*—Jack Wang
(74) *Attorney, Agent, or Firm*—Nixon & Vanderhye P.C.

(57) ABSTRACT

A system and/or method for increasing safety in areas in which people work and/or through which people travel that potentially may become blocked (e.g. mines, mineshafts, tunnels, etc.) is provided. In certain example embodiments, a system and/or method is provided wherein a sensor locates individuals who may be trapped and conveys their location(s) after an area becomes blocked. Sensors may be disposed throughout the area, located on individuals, etc. Sensors may be located behind protected coverings (e.g. glass), and they may locate individuals through, for example, low power, ultrasound, infrared techniques, etc. In certain example embodiments of this invention, one or more conduits may provide a supply of breathable air to individuals who may be trapped after the area becomes blocked.

26 Claims, 6 Drawing Sheets

MINE SAFETY SYSTEM

FIELD OF THE INVENTION

This invention relates to a system and/or method for increasing safety in areas in which people work and/or through which people travel that potentially may become blocked (e.g. mines, mineshafts, tunnels, caves, etc.). In certain example embodiments of this invention, a system and/or method is provided wherein a sensor locates individuals who may be trapped and conveys their location(s) after an area becomes blocked. Sensors may be disposed throughout the area, located on individuals, etc. In certain example embodiments of this invention, one or more conduits may provide a supply of breathable air to individuals who may be trapped.

BACKGROUND AND SUMMARY OF EXAMPLE EMBODIMENTS OF THE INVENTION

Industrial accidents take the lives of thousands each year. One type of industrial accident involves cave-ins in mining operations. Even though the mining industry is highly regulated and inspections of mines and mineshafts occur regularly and on surprise bases, accidents still happen. Examples of accidents are numerous, and the facts of each situation tend to vary. A 1968 accident in Farmington, W. Va. claimed the lives of 78 miners. In 2002, nine Pennsylvania coal miners were trapped for 77 hours in a flooded mineshaft 240 feet underground. More recently, an accident at Sago Mine in January 2006 trapped 12 of 130 workers for 41 hours and killed at least one other—thus, fully ten percent of the workforce was either trapped or killed by the accident. The U.S. Mine Safety and Health Administration had issued numerous citations to Sago Mine in the months leading up to the accident, including a citation less than several weeks before the most recent accident. Therefore, at least in this last example, despite pervasive regulations and the combination of periodic and unannounced surprise inspections, such measures have not prevented accidents, mitigated the damages, or provided quick and effective solutions after such accidents have occurred.

One hazard potentially encountered in mining operations is a cave-in. Cave-ins may result from, for example, detonations, drilling too deeply, inadequate ceiling support, etc. Rocks, rubble, debris, and the like threaten to crush workers in the areas around the cave-in itself, and/or in areas where an initial cave-in might have led to other, ancillary cave-ins. Other workers may become trapped miles underground without a way out and without a way of indicating their locations to those who can help. These trapped workers may slowly suffocate if there is not an adequate supply of breathable air, as breathable air slowly is replaced with carbon dioxide and carbon monoxide from respiration and mining operations. Even when they do have adequate oxygen supplies, workers nonetheless may slowly run out of food, water, and other necessities while rescue operations take place. The longer miners are exposed to dust and other debris, the greater the likelihood they will develop silicosis and/or other lung diseases later in life. Even when miners are rescued, then, they still may suffer irreparable harms that only will be manifested years later. Thus, there often is a race against time to try to find workers in potentially miles-long mines that may be hampered by these and/or other realities of the mining industry.

Coal and carbon monoxide are combustible, potentially making both rescue operations and survival techniques more difficult. The technologies that can be used to locate, sustain the lives of, and ultimately rescue workers therefore are limited. For example, care must be taken to avoid setting off any sparks that might ignite any carbon monoxide or coal. Lighting devices to be used by rescue workers and trapped miners are similarly limited.

These and other dangers may be present in other areas outside of industrial mines. For example, such dangers also may be present, for example, in tunnels, regardless of whether those tunnels are traversed by foot, car, or train. And tunnels that travel through waterways are potentially more dangerous, as cave-ins may permit water seepage. A small cave-in may even cause a breech along the length of the tunnel, for example, if the water pressure is sufficiently great.

Caving expeditions also may be similarly susceptible to cave-ins. While some more experienced spelunkers may know how to react if an accident happens, other may have no idea what to do in the case of an accident. Indeed, panic may set in and exacerbate an already potentially deadly situation.

Thus, it will be appreciated that there is a need for a system and/or method for increasing safety in areas that potentially may become blocked and/or where the locating of individuals may become difficult. In certain example embodiments, a method of locating an individual trapped in a mine is provided. The method may comprise detecting a cave-in; when a cave-in is detected, releasing one or more sensors to sense the individual's presence; and, transmitting a location corresponding to the individual's presence from the one or more sensors. In certain example embodiments, the method further comprises waiting a predetermined amount of time before releasing the one or more sensors. The cave-in may be detected by monitoring one or more of heat, seismic activity, sound, ambient dust, and/or a user-operated signal. In certain example embodiments, the one or more sensors are released from within protective housings, and in certain example embodiments the protective housings are glass. In certain example embodiments, the one or more sensors are low-powered, non-combustible sensors, which may comprise one or more of an infrared detector, an ultrasound device, and/or a microphone. In certain example embodiments, the location is transmitted wirelessly, and in certain example embodiments, the method further comprises providing a supply of breathable gas into the mine through one or more preexisting conduits. A predetermined amount of time may pass before providing the supply of breathable gas, and the method may further comprise unsealing the one or more preexisting conduits before providing the supply of breathable gas.

In certain other example embodiments, a system for locating an individual trapped in a mine is provided, comprising a cave-in detector operable to detect a cave-in, wherein the cave-in detector monitors one or more of heat, seismic activity, sound, ambient dust, and/or a user-operated signal; one or more sensors operable to sense the individual's presence; and, a transmitter operably connected to the sensor, the transmitter operable to send a location corresponding to the individual's presence from the one or more sensors. The one or more sensors may wait a predetermined amount of time before becoming active. The system may further comprise protective housings around the one or more sensors from which the one or more sensors can emerge when the cave-in detector detects a cave-in. In certain example embodiments, the one or more sensors may be low-powered, non-combustible sensors, and in certain example embodiments the one or more sensors comprises one or more of an infrared detector, an ultrasound device, and/or a microphone. The transmitter may be a wireless transmitter. In certain example embodiments, the system may further comprise one or more preexisting conduits through which a supply of breathable gas can flow into the mine. The one or more preexisting conduits may further comprise seals, the seals remaining on the one or more preexisting conduits until the supply of breathable gas is ready to flow into the mine.

In certain example embodiments of this invention, transfer of information can be designed to be permitted from both ends of a communication wire or the like. For example, a sensor can be provided at an approximate midpoint of a wire in the mine; and if the wire is broken or damaged on one side of the sensor then data transfer can still be performed using the wire on the other side of the sensor. This provides for increased redundancy for efficiency and safety purposes.

In still other example embodiments, there is provided a method of locating an individual trapped in a mine, with the method comprising detecting a cave-in; sending a signal from a transmitter carried by the individual; and, having one or more sensors sense the signal sent from the transmitter carried by the individual. The method may further comprise waiting a predetermined amount of time before releasing and/or activating the one or more sensors and/or transmitter, and the signals may contain location and/or bio-statistical information about the individual.

In certain example embodiments, a system for locating an individual trapped in a mine is provided, comprising a cave-in detector operable to detect a cave-in, wherein the cave-in detector monitors one or more of heat, seismic activity, sound, ambient dust, and/or a user-operated signal; a transmitter carried by the individual, the transmitter transmitting a signal comprising location and/or bio-statistical information about the individual; and, one or more sensors operable to receive the signal from the transmitter. In such systems, the one or more sensors and/or transmitter may wait a predetermined amount of time before becoming active.

In certain example embodiments, there is provided a method of supplying breathable air to an individual trapped in a mine, with the method comprising detecting a cave-in; locating the individual; designating one or more preexisting conduits through which the supply of breathable air can flow; and providing the supply of breathable air through the designated one or more preexisting conduits. The method may further comprise unsealing the designated one or more preexisting conduits and/or waiting a predetermined amount of time before providing the supply of breathable gas. The cave-in may be detected by monitoring one or more of heat, seismic activity, sound, ambient dust, and/or a user-operated signal.

In certain example embodiments of this invention, air may be supplied to-a miner via a quick-connect oxygen providing device which is operatively associated with a pressure sensor. The quick-connect oxygen providing device and oxygen sensor are located under the ground in the mine area. The pressure sensor, upon detecting a large change in pressure or other pressure data which may be indicative of an explosion, may halt or stop operation of any oxygen supplying device/equipment to prevent explosions from the same. In this regard, in certain example embodiments, when the oxygen supplying conduit is stopped or shut down, a transceiver may be inserted through the same conduit or other supplied to the interior of the mine in cave-in areas so as to permit those outside the mine to communicate with those inside the mine in or proximate cave-in areas.

In certain example embodiments, a system for supplying breathable air to an individual trapped in a mine is provided, comprising a cave-in detector operable to detect a cave-in, wherein the cave-in detector monitors one or more of heat, seismic activity, sound, ambient dust, and/or a user-operated signal; a locator operable to locate the individual's location and/or the cave-in's location; and, one or more preexisting conduits through which the supply of breathable air can flow. In certain example embodiments, one or more preexisting conduits further comprise seals, the seals remaining on the one or more preexisting conduits until the supply of breathable gas is ready to flow into the mine.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
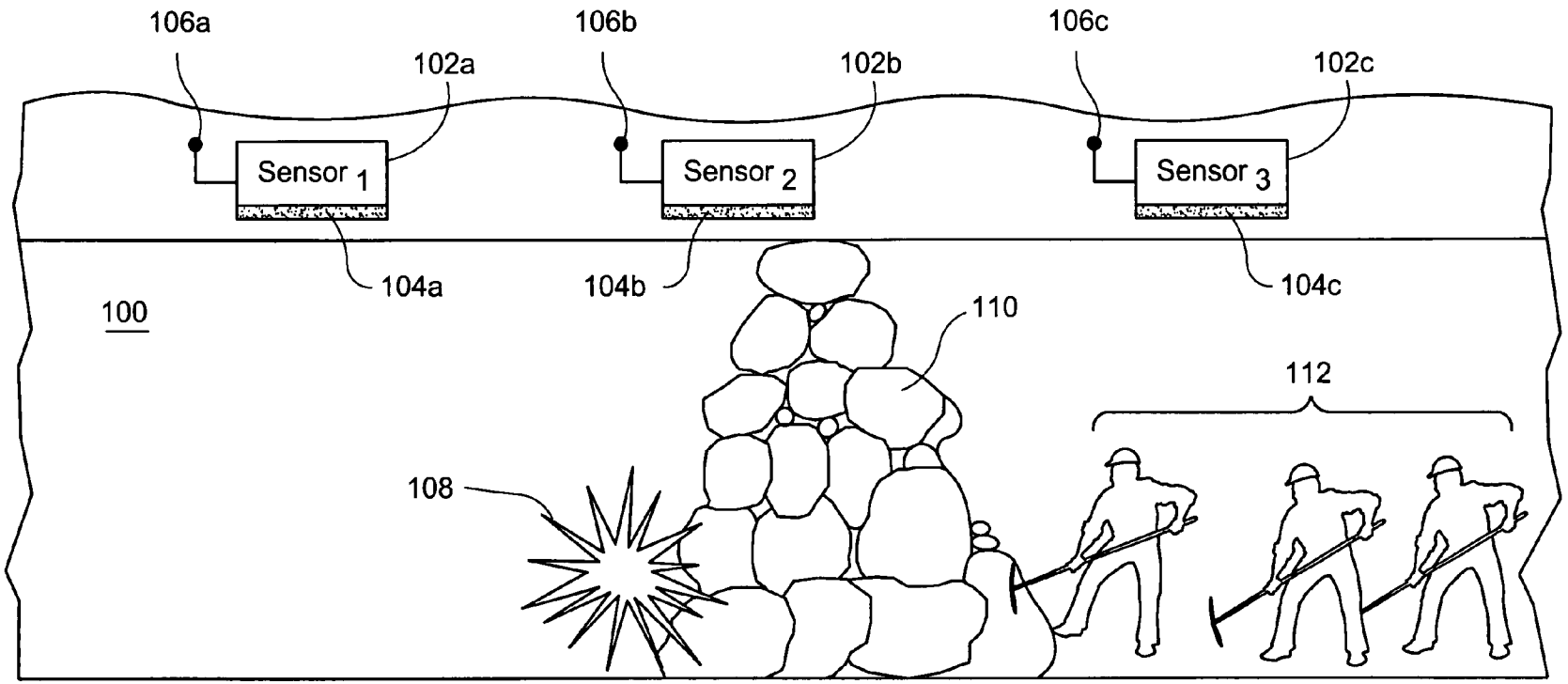
FIG. 1 is a partial schematic view of a system for locating individuals in accordance with an example embodiment.

Referring now to the drawings in which like reference numerals indicate like parts throughout the several views, FIG. 1 is a partial schematic view of a system for locating individuals.

In FIG. 1, safety devices are positioned throughout the length of mine shaft 100. The safety devices may be positioned periodically and/or aperiodically throughout shaft 100. For example, it may be advantageous to position safety devices closer together when there is, for example, a sharp turn, steep drop, or the like that may make communication difficult because of interference, poor communications range, etc.

The safety devices shown may be sensors 102*a-c*. It will be appreciated that the number and/or locations of deployed safety devices may be based on, for example, the characteristics of the mine (e.g. length, height, type of mine, etc.), the sensors themselves (e.g. detection and transmission ranges, etc.), and/or other factors. Sensors 102*a-c* may detect, for example, the presence of a cave-in and/or the presence of worker(s). Sensors 102*a-c* may each comprise infrared, ultrasound, and/or other detectors capable of detecting cave-ins and/or the presence of one or more workers. Preferably, sensors 102*a-c* comprise low-power detectors that avoid igniting any combustible materials that may be present in mine shaft 100. Sensors 104*a-c* may be stored in protective housings 104*a-c* (e.g. glass housings) until an explosion is detected.

Communicators 106*a-c* may be operably connected to sensors 102*a-c*, and communicators 106*a-c* may be configured to transmit data gathered by sensors 104*a-c*. For example, communicators 106*a-c* may transmit the location(s) of trapped workers, the location(s) of cave-ins, etc. Communicators 106*a-c* may transmit data to rescue workers (not pictured), and they may transmit the data wirelessly or through hard-wired connections. In certain example embodiments, communicators 106*a-c* may function as relays, passing data among and/or between communicators 106*a-c* and/or other communications elements, ultimately to rescue workers.

Still referring to FIG. 1, assume that explosion 108 causes blockage 110 to block passage through mine shaft 100 and stranding workers 112. In certain example embodiments, explosion 108 may be detected by sensors 102*a-c*, while in certain other example embodiments a separate detector (not shown) may detect the explosion. Explosions may be detected by, for example, monitoring seismic activity, measuring certain portions of the sound spectrum (e.g. to determine whether a cave-in is occurring), monitoring the light moving through shaft 100, measuring the ambient dust in shaft 100, detecting fluctuations in heat, etc. In certain example embodiments, an explosion may be detected (and/or reported) by an individual working in the mine.

When an explosion is detected, sensors 102*a-c* may become activated. In certain example embodiments, sensors 102*a-c* may wait a predetermined amount of time before becoming activated to, for example, allow debris to settle, avoid damage to the sensors, give workers a chance to escape, etc. It will be appreciated that sensors 102*a-c* may be activated automatically (e.g. an explosion detector may cause a sensor to become activated) and/or manually (e.g. a worker may signal that an explosion has occurred and/or cause the sensors to become activated). Sensors 102*a-c* may search for workers 112 trapped by blockage 110 by, for example, searching for heat generated by the bodies of workers 112. In certain other embodiments, sensors 102*a-c* may search for other signs of life, such as, for example, noises. As noted above, this information may be transmitted by communicators 106*a-c*.

Figure 2:
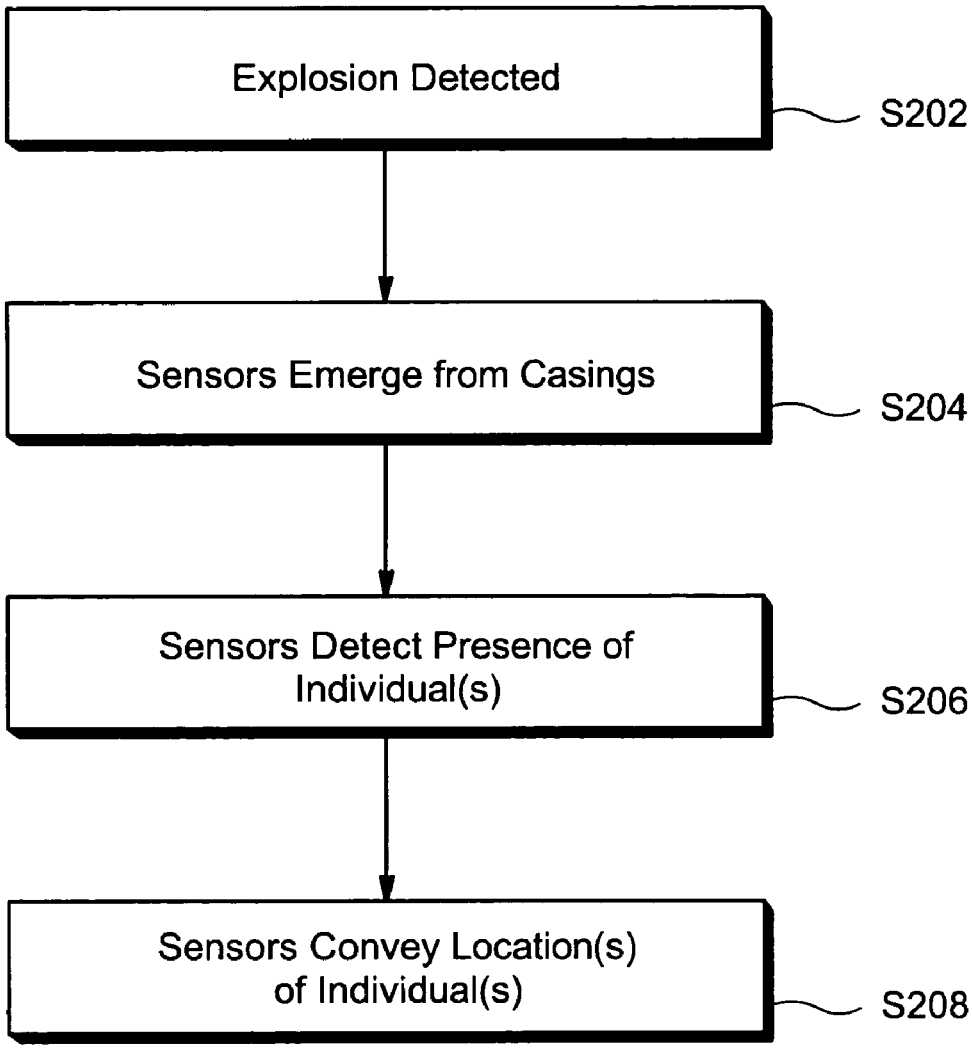
FIG. 2 is an illustrative flowchart showing a method for locating individuals in accordance with an example embodiment.

FIG. 2 is an illustrative flowchart showing a method for locating individuals. An explosion is detected in step S202. After waiting a predetermined amount of time, sensors become activated and emerge from their protective housings in step S204. In step S206, the sensors detect the presence of any individual(s) who may be trapped in the mine. Location information may be conveyed from the sensors in step S208. In a step not shown, this location information may aid rescue workers to target their searches, provide services to trapped individuals, etc.

Figure 3:
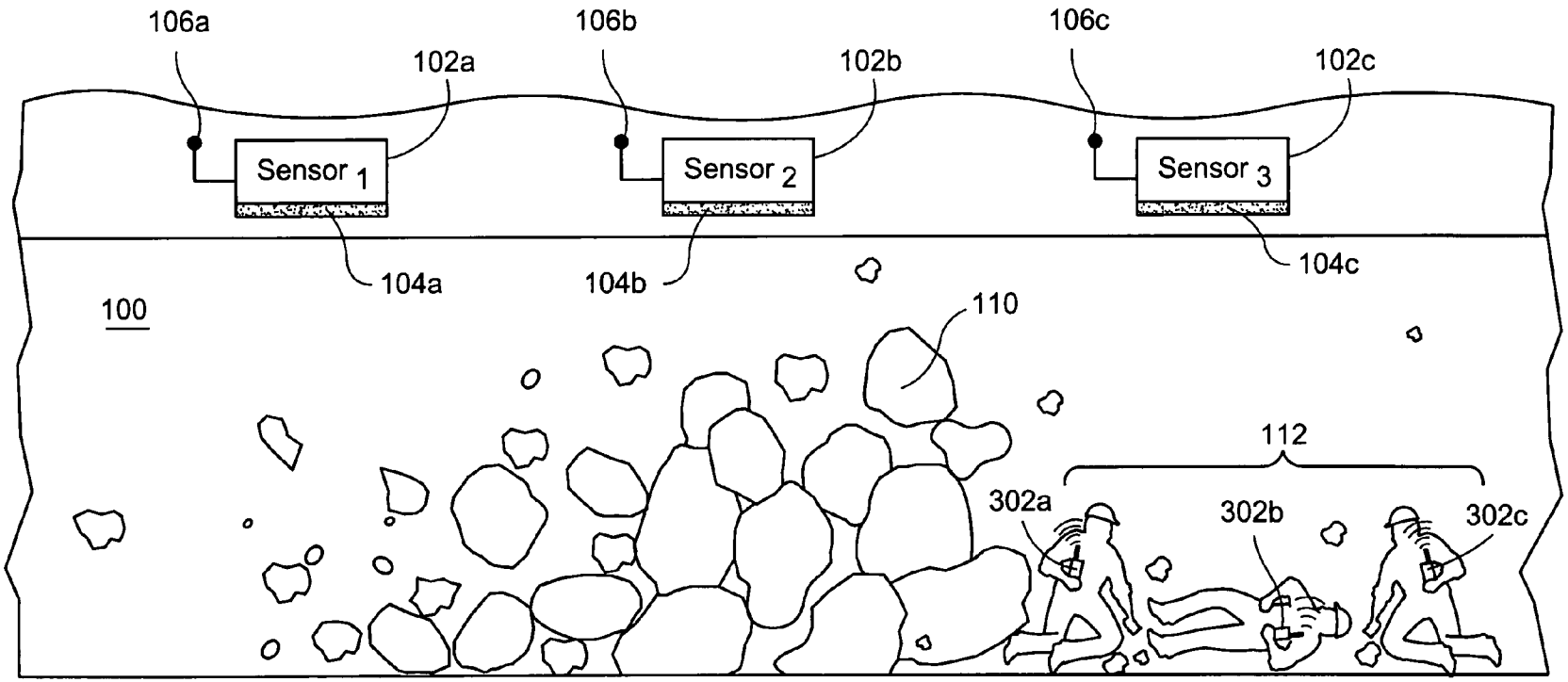
FIG. 3 is a partial schematic view of a system for locating individuals having transmitters in accordance with an example embodiment.

FIG. 3 is a partial schematic view of a system for locating individuals having transmitters. Example embodiments in accordance with FIG. 3 are like those example embodiments in accordance with FIG. 1. However, in FIG. 3, workers 112 have transmitters 302*a-c*. Rather than having sensors 102*a-c* seek out workers, sensors 102*a-c* may simply seek out signals emanating from transmitters 302*a-c*. It will be appreciated that each person may have a transmitter 302, a group working together may share a single transmitter 302, etc. It also will be appreciated that transmitters 302 may be integrated into workers' uniforms (e.g. located on helmets), may be carried separately, or may be located throughout shaft 100 for use when there is an explosion.

In certain example embodiments, transmitters 302*a-c* may become activated only after an explosion is detected (e.g. automatically or manually), while in certain other example embodiments, transmitters 302*a-c* may be always on. In the latter of these embodiments, a monitor (not shown) may track the locations of workers and report on their last-known location in case of an accident. Transmitters 302*a-c* may transmit location data wirelessly. In certain example embodiments, transmitters 302*a-c* may also convey bio-statistical information such as, for example, heart rate, blood pressure, body temperature, etc. to indicate whether the worker carrying the particular transmitter is alive and well, in addition to conveying information as to the individual's location.

Figure 4:
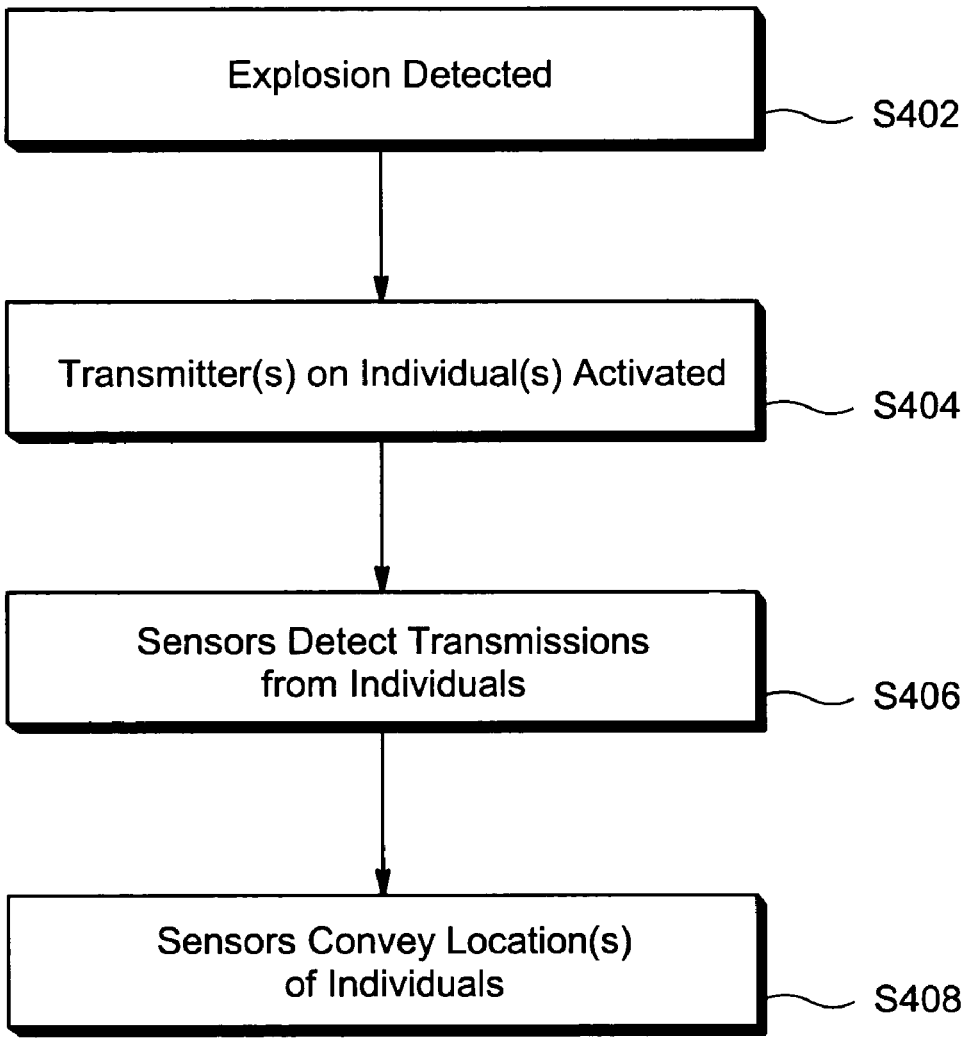
FIG. 4 is an illustrative flowchart showing a method for locating individuals having transmitters in accordance with an example embodiment.

FIG. 4 is an illustrative flowchart showing a method for locating individuals having transmitters. In step S402, an explosion is detected. Transmitters on individuals are activated in step S404. As noted above, such transmitters may be activated automatically or manually. Sensors disposed throughout the mine may detect the signals coming from the transmitters carried by the individuals in step S406. Then, the sensors may convey location and/or other data pertaining to the individuals in step S408 to aid rescue workers in their efforts to locate and save trapped workers.

Figure 5:
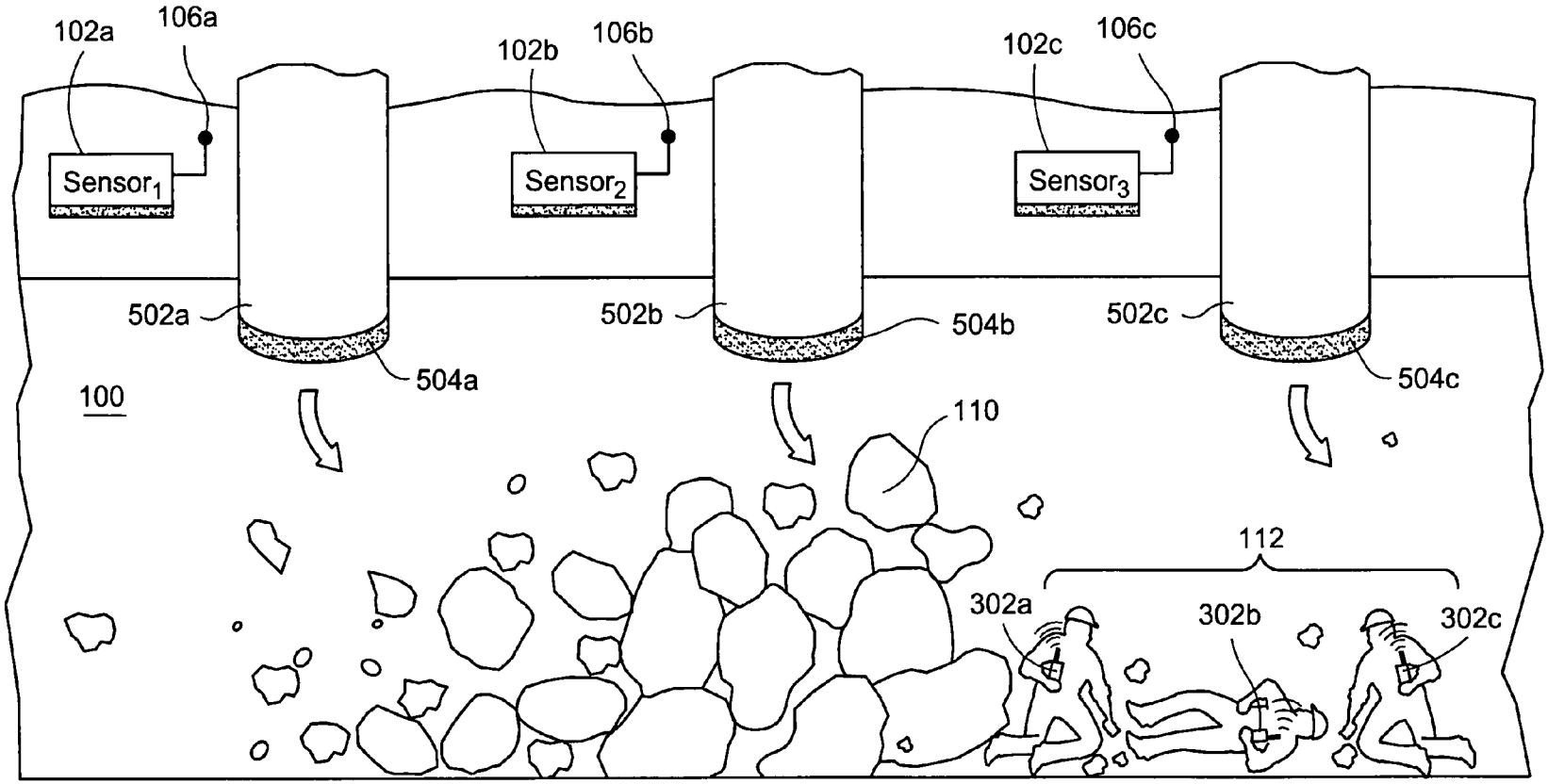
FIG. 5 is a partial schematic view of a system for locating individuals and providing them with a supply of breathable gas in accordance with an example embodiment; and, FIG. 6 is an illustrative flowchart showing a method for locating individuals and providing them with a supply of breathable gas in accordance with an example embodiment.

FIG. 5 is a partial schematic view of a system for locating individuals and providing them with a supply of breathable gas. Example embodiments in accordance with FIG. 5 are like those example embodiments in accordance with FIG. 1 and/or FIG. 3. However, FIG. 5 also shows conduits 502*a-c* running into shaft 100. Conduits 502*a-c* may be located throughout the length of shaft 100. After an explosion is detected, the series of preexisting conduits may provide a supply of breathable gas to shaft 100. Conduits 502*a-c* may be sealed by caps 504*a-c* until an explosion is detected. Accordingly, caps 504*a-c* may cover conduits 502*a-c* until an explosion is detected. In certain example embodiments, breathable air may not begin to flow until a predetermined amount of time has passed after an explosion and/or cave-in to, for example, avoid spreading fires by providing highly-combustible gas into shaft 100.

Conduits 502*a-c* may work in concert with sensors 102*a-c*. For example, sensors 102*a-c* may direct conduits 502*a-c* to open. In certain example embodiments, not all conduits may open after an explosion is detected. Instead, in certain example embodiments, only those conduits where individuals are trapped may open. Sensors 102*a-c* thus may determine which of conduits 502*a-c* should open, when they should open, and whether a supply of breathable gas should flow.

Figure 6:
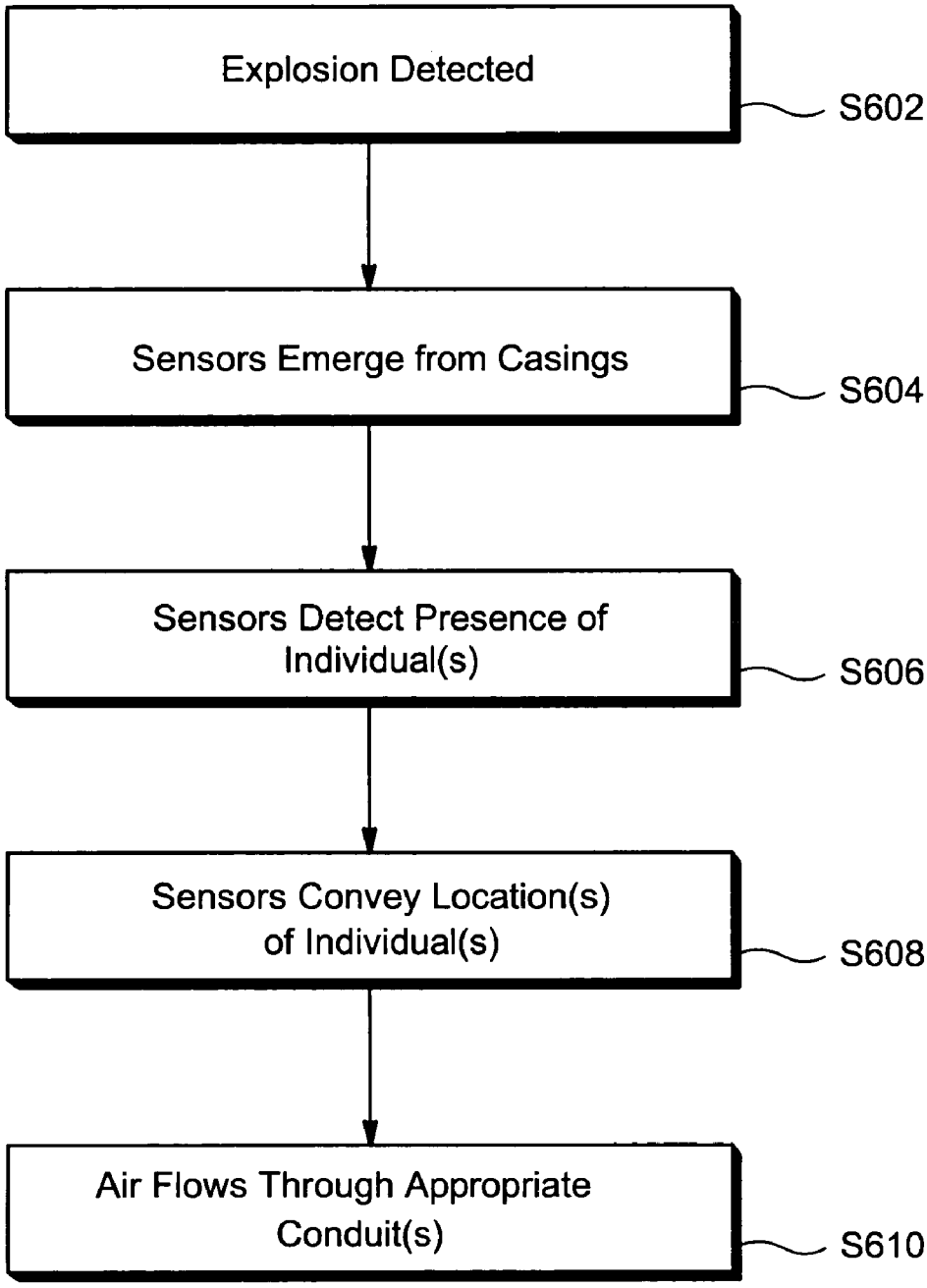

FIG. 6 is an illustrative flowchart showing a method for locating individuals and providing them with a supply of breathable gas. An explosion is detected in step S602. After waiting a predetermined amount of time, sensors become activated and emerge from their protective housings in step S604. In step S606, the sensors detect the presence of any individual(s) who may be trapped in the mine. Location information may be conveyed from the sensors in step S608. In step S610, a supply of breathable air flows through the appropriate conduit(s). As noted above, depending on the example embodiment, air may flow through all conduits or only certain conduits (e.g. those near where individuals are trapped).

The example embodiments disclosed herein have been described as pertaining to cave-ins in mines and mineshafts with explosions being the causes of those cave-ins. However, the invention is not so limited. To the contrary, it will be appreciated that the techniques described herein could be applied to, for example, natural caves, tunnels, etc. It also will be appreciated that the precise cause of a cave-in is not limited to explosions. Cave-ins may be caused by, for example, poor or eroding support structures, natural disasters (e.g. an earthquake, typhoon, or the like), etc. Thus, detectors may monitor for one or more of these causes of cave-ins, in place of, or in addition to, monitoring for explosions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of locating an individual trapped in a mine, the method comprising:

detecting a cave-in;

when a cave-in is detected, releasing one or more sensors configured to sense the individual's presence, each said sensor being released from a corresponding protective housing;

activating each said sensor to sense the individual's presence; and, transmitting a location corresponding to the individual's presence from the one or more sensors.

2. The method of claim 1, further comprising waiting a predetermined amount of time before releasing the one or more sensors.

3. The method of claim 1, wherein the cave-in is detected by monitoring one or more of heat, seismic activity, sound, ambient dust, and/or a user-operated signal.

4. The method of claim 1, wherein the protective housings are glass.

5. The method of claim 1, wherein the one or more sensors are low-powered, non-combustible sensors.

6. The method of claim 5, wherein the one or more sensors comprises one or more of an infrared detector, an ultrasound device, and/or a microphone.

7. The method of claim 1, wherein the location is transmitted wirelessly.

8. The method of claim 1, further comprising providing a supply of breathable gas into the mine through one or more preexisting conduits.

9. The method of claim 8, further comprising waiting a predetermined amount of time before providing the supply of breathable gas.

10. The method of claim 8, further comprising unsealing the one or more preexisting conduits before providing the supply of breathable gas.

11. A system for locating an individual trapped in a mine, comprising:

a cave-in detector operable to detect a cave-in, wherein the cave-in detector monitors one or more of heat, seismic activity, sound, ambient dust, and/or a user-operated signal;

one or more sensors operable to sense the individual's presence, each said sensor being activatable and releasable from a corresponding protective housing upon the cave-in detector detecting a cave-in; and, a transmitter operably connected to the sensor, the transmitter being operable to send a location corresponding to the individual's presence from the one or more sensors.

12. The system of claim 11, wherein the one or more sensors wait a predetermined amount of time before becoming active.

13. A method of locating an individual trapped in a mine, the method comprising:

detecting a cave-in;

sending a signal from a transmitter carried by the individual; and, releasing one or more sensors configured to sense the signal sent from the transmitter carried by the individual upon the detection of a cave-in, each said sensor being released from a corresponding protective housing.

14. The method of claim 13, further comprising waiting a predetermined amount of time before releasing activating the one or more sensors and/or transmitter.

15. The method of claim 13, wherein the signal contains location and/or bio-statistical information about the individual.

16. The method of claim 13, wherein the one or more sensors are low-powered, non-combustible sensors.

17. The method of claim 13, further comprising providing a supply of breathable gas into the mine through one or more preexisting conduits.

18. The method of claim 13, further comprising waiting a predetermined amount of time before providing the supply of breathable gas.

19. The method of claim 18, further comprising unsealing the one or more preexisting conduits before providing the supply of breathable gas.

20. A system for locating an individual trapped in a mine, comprising:

a cave-in detector operable to detect a cave-in, wherein the cave-in detector monitors one or more of heat, seismic activity, sound, ambient dust, and/or a user-operated signal;

a transmitter carried by the individual, the transmitter configured to transmit a signal comprising location and/or bio-statistical information about the individual; and, one or more sensors operable to receive the signal from the transmitter, each said sensor being activatable and releasable from a corresponding protective housing upon the cave-in detector detecting a cave-in.

21. A method of supplying breathable air to an individual trapped in a mine, the method comprising:

detecting a cave-in;

locating the individual by performing the method of claim 1;

designating one or more preexisting conduits through which the supply of breathable air can flow; and providing the supply of breathable air through the designated one or more preexisting conduits.

22. The method of claim 21, further comprising unsealing the designated one or more preexisting conduits.

23. The method of claim 21, further comprising waiting a predetermined amount of time before providing the supply of breathable gas.

24. The method of claim 21, wherein the cave-in is detected by monitoring one or more of heat, seismic activity, sound, ambient dust, and/or a user-operated signal.

25. A system for supplying breathable air to an individual trapped in a mine, comprising:

a cave-in detector operable to detect a cave-in, wherein the cave-in detector monitors one or more of heat, seismic activity, sound, ambient dust, and/or a user-operated signal;

a locator operable to locate the individual's location and/or the cave-in's location via the system of claim 11; and, one or more preexisting conduits through which the supply of breathable air can flow.

26. The system of claim 25, wherein the one or more preexisting conduits further comprise seals, the seals remaining on the one or more preexisting conduits until the supply of breathable gas is ready to flow into the mine.

* * * * *